United States Patent [19]

Tiepel et al.

[11] 4,053,432

[45] Oct. 11, 1977

[54] VOLUME REDUCTION OF SPENT RADIOACTIVE ION-EXCHANGE MATERIAL

[75] Inventors: Erich W. Tiepel, Export; Christopher K. Wu, Wilkins; Arnold S. Kitzes, Pittsburgh, all of Pa.

[73] Assignee: Westinghouse Electric Corporation, Pittsburgh, Pa.

[21] Appl. No.: 663,035

[22] Filed: Mar. 2, 1976

[51] Int. Cl.[2] ..... G21F 9/32

[52] U.S. Cl. ..... 252/301.1 W

[58] Field of Search ..... 252/301.1 W

[56] References Cited

U.S. PATENT DOCUMENTS

| | | | |
|---|---|---|---|
| 3,791,981 | 2/1974 | Calmon | 252/301.1 W |
| 3,856,622 | 12/1974 | Pollock | 252/301.1 R |
| 3,865,745 | 2/1975 | Block et al. | 252/301.1 R |

FOREIGN PATENT DOCUMENTS

| | | | |
|---|---|---|---|
| 886,004 | 1/1962 | United Kingdom | 252/301.1 W |

*Primary Examiner*—Benjamin R. Padgett
*Assistant Examiner*—Deborah L. Kyle
*Attorney, Agent, or Firm*—M. S. Yatsko

[57] ABSTRACT

A process for reducing the volume of spent organic radioactive ion-exchange material which has been used for conditioning water circulated through a nuclear reactor. The spent radioactive ion-exchange material is removed from the reactor system and inserted into a dryer, where the residual free water and some of the intrinsic water in the ion-exchange material is removed so that the ion-exchange material has a moisture content less than 50% by weight. The dried ion-exchange material is then inserted into a fluid bed reactor, a carrier gas is inserted into the reactor and fluidizes the ion-exchange material, and the ion-exchange material is heated. The heating thermally decomposes the ion-exchange material, producing an effluent gas, which contains the volatile decomposition products. The carrier gas and the effluent gas are removed from the fluid bed reactor. After the thermal decomposition, or pyrolysis, is completed, the insertion of the carrier gas into the reactor is stopped and an oxygen-containing gas is inserted into the reactor. The remaining ion-exchange material is burned with the oxygen-containing gas, and a volume reduction of approximately 20:1, depending on the inorganic species loading, is obtained from the original settled bed volume of ion-exchange material to the end product.

10 Claims, 2 Drawing Figures

VOLUME REDUCTION OF SPENT RADIOACTIVE ION-EXCHANGE MATERIAL

BACKGROUND OF THE INVENTION

This invention relates generally to ion-exchange material, and more particularly to a volume reduction process for spent radioactive ion-exchange material.

Ion-exchange resins are conventionally used in various nuclear reactor coolant, water makeup, and other systems for removing mineral, metallic, and other impurities from water circulated through a reactor and its associated components. Contrary to practices followed in commercial and domestic ion-exchange systems used for conditioning water, the radioactive resins in the reactor systems usually are not regenerated, and once spent, must be disposed of as radioactive waste.

Various methods have been developed for disposing of the radioactive water and resins. Currently, the spent resins are separated from a resin-water mixture by utilizing a centrifuge which isolates the resins to eventually form a radioactive paste or cake which is disposed of in suitable containers. In those cases where disposal of the water does not take place, it is recycled to the waste process system for further use.

In another system, the resin-water mixture is mixed with a fixing agent, and discharged to an appropriate disposal package. In a third system, the resin-water mixture is discharged into an evacuated drum filled with dry mixture of cement and vermiculite, and equipped with a screen cage insert. The mixture fills the cage and water seeps through the screen into the cement-vermiculite mixture lining the cage, thereby encapsulating the resin in a lining of solidified concrete.

All of these disposal methods are expensive because large volumes of radioactive resin in water must be contained in an appropriate receptacle to eliminate the possibility of later escape to the environment in which the receptacles are buried or stored. Moreover, a substantial effort in terms of time and labor cost, and material cost, is required for the encapsulation of the radioactive waste products in order to comply with prevailing rules and regulations for the disposal of radioactive materials.

In order to minimize the economic costs associated with the disposal, various methods have been attempted to reduce the volume of the spent radioactive ion-exchange materials. One of these methods is to incinerate the ion-exchange material. Incineration does provide a high volume reduction ratio in terms of solid residue. However, the incineration takes place at relatively high temperatures, typically above 1000° C, and in an oxidizing atmosphere. Such operating conditions can produce fine dust entrainment and possibly radioactive volatile formation such as ruthenium tetroxide, $RuO_4$and cesium sulfate, $Cs_2SO_4$. The removal of the entrained solids and the volatile radioactive gases from the hot exhaust gases is a major and difficult process.

Another volume reduction method attempted was acid digestion. Acid digestion is a form of wet oxidation of solid waste. The radioactive ion-exchange materials are digested with concentrated sulfuric acid and nitric acid. The gases given off are passed through absorbers to remove the sulfur dioxide and nitric oxide. The acid digestion process also provides a high volume reduction ratio for a solid residue. However, acid digestion generates a large volume of contaminated liquid waste, must be operated in glass or glass-lined vessels, and requires similar radioactive treatment of gases given off as does incineration.

Mechanical compaction of the spent radioactive ion-exchange materials is not feasible, since very limited volume reductions are to be expected.

SUMMARY OF THE INVENTION

Briefly stated, the aforementioned disadvantages of the prior art are eliminated by this invention by providing a process which substantially reduces the volume of radioactive organic ion-exchange materials while minimizing the amount of radioactive release to the off-gas system. The ion-exchange material is removed from the ion-exchangers, dried to a moisture content less than 50% by weight, and inserted into a fluid bed reactor. A carrier gas is inserted into the fluid bed reactor, and the ion-exchange material is heated. The heating thermally decomposes the ion-exchange material, producing an effluent gas containing the volatile decomposition products. The carrier and effluent gases are removed from the fluid bed reactors, and after the ion-exchange material has thermally decomposed, the insertion of carrier gas is stopped, and an oxygen-containing gas is inserted in the reactor. The remaining ion-exchange material is burned with the oxygen-containing gas, and a final volume reduction of approximately 20:1 from the original ion-exchange material settled bed volume is obtained. The effluent gas is supplied to an afterburner, where it is combusted with air or oxygen, passed through a filter to remove any entrained solids, passed through an absorption material to remove any acid gases or radioactive species passed through a high efficiency particulate absolute filter to remove any fine dust present, and expelled to the atmosphere. The final gas phase composition consists of carbon dioxide, water, nitrogen, and oxygen.

BRIEF DESCRIPTION OF THE DRAWINGS

Reference is now made to the description of the preferred embodiment, taken in connection with the accompanying drawings, in which.

DESCRIPTION OF THE PREFERRED EMBODIMENT

In accordance with conventional practice, conditioned water supplied to various nuclear reactor systems flows through ion-exchange materials which remove minerals, metallic ions, and other foreign substances. The ion-exchange material is generally a styrene-based ion-exchange resin. The ion-exchange material used in the nuclear reactor system is generally contained in an ion-exchanger, and this ion-exchanger is generally of the mixed-bed variety. By this mixed-bed variety, it is meant that the ion-exchange material contains both cation resin and anion resin. This mixed-bed exchanger can then remove both cation and anion species. When the ion-exchange material in the reactor system fails to effectively remove the ions, it is considered spent, and is removed from the system and disposed of as radioactive waste.

Figure 1:
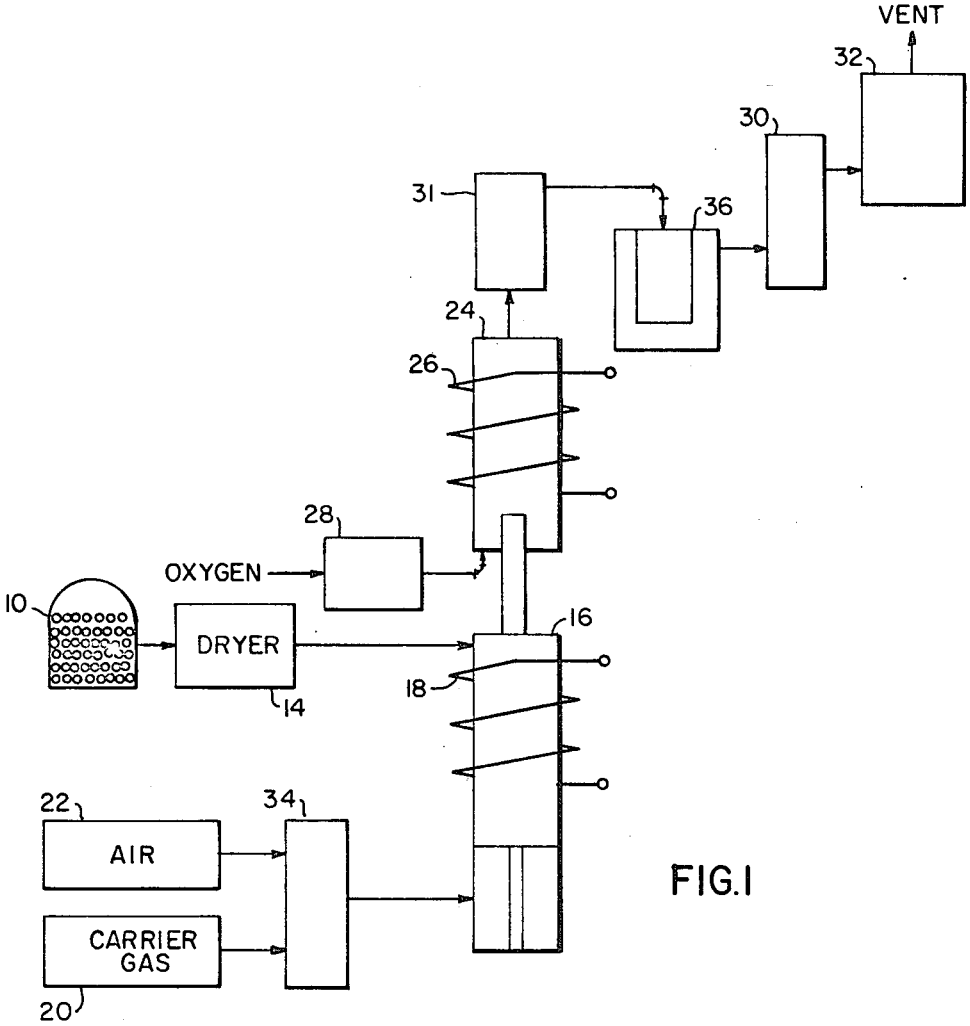
FIG. 1 is a block diagram of the volume reduction process.

Referring now more particularly to FIG. 1, a block diagram of the volume reduction process, the ion-exchange material 10 is located in an ion-exchanger 12. The ion-exchanger 12 is part of a nuclear reactor system (not shown). When the ion-exchange material 10 is spent, it is removed from the ion-exchanger 12 and dried in a dryer 14. The drying step may occur by any of numerous type of processes, such as by drum drying, fluidized-bed drying, air drying or vacuum drying. The ion-exchange material 10 is dried until its moisture content is less than 50% by weight.

After drying, the ion-exchange material is supplied to a fluid-bed reactor 16. After the ion-exchange material is inserted into the fluid-bed reactor 16, a carrier gas 20 is inserted into the fluid-bed reactor 16. The carrier gas 20 functions to fluidize the ion-exchange material 10. The carrier gas 20 may be an inert gas such as nitrogen, helium, argon, or it may be a non-oxygenated gas such as hydrogen, or may be a gas with limited free oxygen such as carbon dioxide. The carrier gas 20 may be heated in a preheater 34 to a temperature of approximately 400° C. After the ion-exchange material 10 is fluidized, the ion-exchange material 10, and the reactor 16, is primarily heated by heaters 18, with some heat being supplied by the heated carrier gas. The heaters 18 may be conventional heaters such as electric or gas heaters. The ion-exchange material 10 is heated to a temperature under 500° C, and preferably around 400° C. The heating of the ion-exchange material 10 serves to thermally decompose the structure of the material 10. This thermal decomposition functions to decompose the cross-linked polymer structure present in the ion-exchange material 10 to form volatile products and a low-volume ash residue.

The thermal decomposition and devolatilization step produces an effluent gas. This effluent gas is continuously carried from the fluid-bed reactor 16 by the carrier gas 20.

Figure 2:
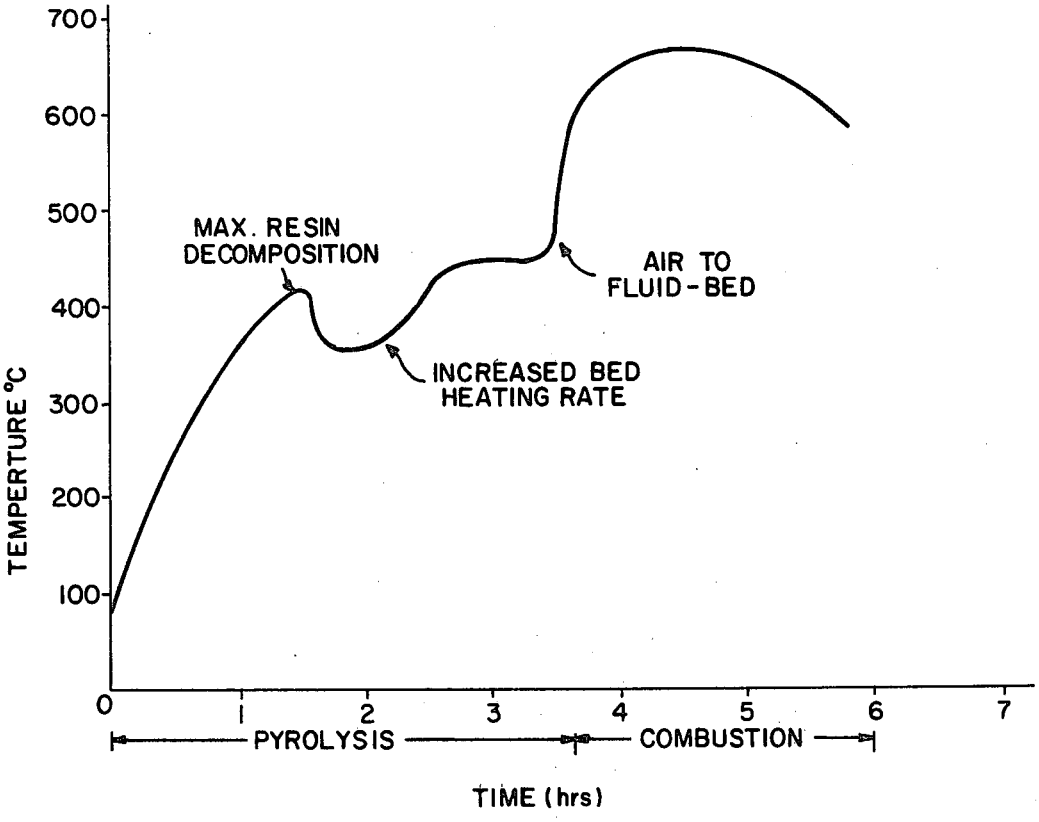
FIG. 2 is a curve of the typical temperatures in the fluid bed reactor.

The thermal decomposition is endothermal; that is, it absorbs more heat than it rejects. (See FIG. 2).As heat is added to the ion-exchange material 10, the thermal decomposition and devolatilization, or pyrolysis, occurs. At approximately 400° C, the maximum thermal decomposition occurs. At this point, the temperature of the ion-exchange material 10 and the reactor 16 becomes lower. As this occurs, the heaters 18 must apply more heat to the reactor 16. This increased heating occurs until the pyrolysis is complete. The pyrolysis can be determined to be completed when the temperature of the ion-exchange material 10 no longer decreases when the amount of heat supplied remains constant. The pyrolysis is generally completed at a temperature of approximately 500° C.

Once pyrolysis has been completed, and all volatile species are removed from the ion-exchange material 10, the insertion of the carrier gas 20 into the reactor 16 is stopped. An oxygen-containing gas 22, such as pure oxygen or air, is then inserted into the fluid-bed reactor 16. The ion-exchange material 10 remaining after the pyrolysis step is burned with the oxygen-containing gas 22. As the ion-exchange material 10 remaining after pyrolysis is at a temperature of approximately 500° C, it burns spontaneously with the oxygen in the gas 22. For this reason, the heaters 18 need no longer to be functioning.

To prevent the formation of radioactive volatiles, such as ruthenium tetroxide, $RuO_4$, a reducing atmosphere must be maintained in the reactor 16 during burning. This maintenance of a reducing atmosphere is accomplished by regulating the insertion of oxygen-containing gas 22 into the reactor 16 such that the gases given off in the burning step are rich in carbon monoxide and hydrogen, but lean (less than stoichiometric air) in carbon dioxide. Additionally, the amount of oxgen-containing gas 22 inserted into the reactor 16 is limited to prevent the temperature in the reactor 16 from exceeding 700° C. This maintenance of a reactor temperature less than 700° C minimizes the formation of the radioactive volatile ruthenium and cesium. The volume of ion-exchange material 10 remaining in the reactor 16 after the step of burning is approximately only 1/20 the settled bed volume of that which was removed from the ion-exchanger 12 dependent upon the level of inorganic mineral loading initially present in the resin. This volume reduced ion-exchange material 10 can then be removed for storage or disposal.

To maintain the residual ion-exchange material 10 in a free-flowing state for easy discharge from the reactor 16, the carrier gas 20 which was inserted into the reactor 16 to fluidize the ion-exchange material 10 therein, should be inserted at a rate in excess of twice the minimum fluidization velocity. The minimum fluidization velocity is the minimum flow rate at which the ion-exchange material 10 will be fluidized. If this carrier gas insertion rate is maintained, the ion-exchange material 10 residue will retain its generally spherical shape and not agglomerate.

The gaseous mixture of carrier gas and effluent gas obtained during the devolatilization step is supplied to an after-burner chamber 24. The after-burner chamber 24 is externally heated by heaters 26 such as electric or gas heaters. Oxygen 28 is inserted into the after-burner 24. In the after-burner 24, the gaseous mixture and the oxygen 28 are combusted at a temperature between 1400° F and 2000° F. In order to get complete oxidation, an excess of oxygen 28 should be inserted in the after-burner 24. The oxygen reacts with the effluent gas, particularly hydrocarbons of the form $C_NH_X$, to obtain carbon dioxide and water.

After combustion in the after-burner 24, the remaining gas is then cooled and filtered by a filter 36 and cooler-scrubber 31 to remove any entrained solids or unburned hydrocarbons remaining in the gas. This step of removing entrained solids and hydrocarbon residue is generally considered to be a rough filter.

The cooler-scrubber 31 cools the incoming gas stream and removes most of the incoming particulates and unburned hydrocarbons. This is done by an evaporative spray using water or an alkaline scrub solution condensation of the water vapor in the cooled gas stream followed by mist elimination, or maintaining the temperature of the cleaned gas above 100° C, is utilized prior to further processing of the gas. The scrub-solution can then either be recycled or disposed of by conventional means.

After having the entrained solids removed, the gas can be passed through an absorber 30. During the absorbing step, any gases not removed in the scrubber-cooler 31, such as sulfur dioxide, nitric oxides, or radioactive volatile species can be absorbed by an absorbent material in the absorber 30.

The gas remaining after the absorbing step is then filtered through a high efficiency particulate absolute filter 32. This high efficiency particulate absolute filter 32 is well known in the art as an absolute filter, that is, it will remove all solid particulates which may be present in a gas. The gas is passed through this filter 32 to remove any fine dust which may be present in the gas. After being filtered, the gas remaining is then discharged to the atmosphere as carbon dioxide, water, nitrogen, and oxygen.

Thus, the process provides a means for reducing the volume of spent radioactive ion-exchange material for ease and economy in disposal, while minimizing the formation of any radioactive volatiles. Additionally, all volatile materials are removed, and the off-gas is discharged to the atmosphere as harmless gases.

What is claimed is:

1. A process for reducing the volume of spent ion-exchange material comprising the steps of:

drying the spent ion-exchange material to a moisture content of less than 50 percent by weight:

supplying said dried ion-exchange material to a fluid-bed reactor;

inserting a carrier gas selected from the group consisting of inert gases, non-oxygenated gases and limited-free-oxygen-containing gases into said fluid-bed reactor to fluidize said ion-exchange material;

heating said ion-exchange material to a temperature less than 500° C in a limited oxygen atmosphere to thermally decompose said ion-exchange material, said thermal decomposition producing an effluent gas;

removing the gaseous mixture of said carrier gas and said effluent gas from said fluid-bed reactor;

inserting an oxygen-containing gas into said reactor; and burning said remaining ion-exchange material at a temperature less than 700° C.

2. The process according to claim 1 wherein the step of burning said remaining ion-exchange material includes burning said remaining ion-exchange material at a temperature greater than 500° C.

3. The process according to claim 1 including supplying said gaseous mixture of said carrier gas and said effluent gas removed from said reactor to an after-burner chamber;

inserting oxygen into said after-burner chamber; and combusting said gaseous mixture and said oxygen in said after-burner chamber.

4. The process according to claim 3 including removing entrained solids, unburned hydrocarbons and acid gases from the gas remaining after combusting.

5. The process according to claim 4 including absorbing acid gases and volatile radioactive species from the gas remaining after removing entrained solids.

6. The process according to claim 5 including filtering the gas remaining after absorbing acid gases and volatile radioactive species through a high efficiency particulate absolute filter.

7. The process according to claim 1 including heating said carrier gas prior to inserting said carrier gas into said reactor.

8. The process according to claim 1 wherein the step of inserting said carrier gas into said reactor includes inserting said carrier gas at a flow rate greater than twice the minimum fluidization flow rate.

9. The process according to claim 1 wherein said carrier gas is an inert gas.

10. The process according to claim 1 wherein said carrier gas is a non-oxygenated gas.

* * * * *